United States Patent [19]

Crowley

[11] 4,309,596

[45] Jan. 5, 1982

[54] FLEXIBLE SELF-LIMITING HEATING CABLE

[75] Inventor: George C. Crowley, Chicago, Ill.

[73] Assignee: Sunbeam Corporation, Chicago, Ill.

[21] Appl. No.: 162,457

[22] Filed: Jun. 24, 1980

[51] Int. Cl.[3] ..... H05B 3/54

[52] U.S. Cl. ..... 219/549; 29/611; 174/106 SC; 174/107; 174/120 SC; 219/504; 219/528; 219/548; 219/212; 252/511; 264/174; 338/22 R; 338/214

[58] Field of Search ..... 219/212, 504, 505, 528, 219/543, 549, 553; 29/611, 619; 338/22 R, 22 SD, 212, 214, 217; 174/106 SC, 107, 120 SC; 252/501, 511; 264/22, 105, 174, 235

[56] References Cited

U.S. PATENT DOCUMENTS

| | | | |
|---|---|---|---|
| 2,575,987 | 11/1951 | York et al. | 219/549 X |
| 2,581,212 | 1/1952 | Spooner, Jr. et al. | 219/212 |
| 3,344,385 | 9/1967 | Bartos et al. | 219/528 X |
| 3,359,524 | 12/1967 | Gallacher et al. | 338/212 |
| 3,757,088 | 9/1973 | Osborn | 219/553 |
| 3,858,144 | 12/1974 | Bedard et al. | 338/22 R |
| 3,861,029 | 1/1975 | Smith-Johannseh et al. | 29/611 |
| 4,200,973 | 5/1980 | Farkas | 29/611 |

FOREIGN PATENT DOCUMENTS

| | | | |
|---|---|---|---|
| 2024579 | 1/1980 | United Kingdom | 219/553 |

*Primary Examiner*—Volodymyr Y. Mayewsky
*Attorney, Agent, or Firm*—George R. Clark; Neil M. Rose; Clifford A. Dean

[57] ABSTRACT

A heating cable having spaced helically wound conductor wires separated by a layer of positive temperature coefficient material which functions as a self-limiting heating element. At least one of the conductor wires is helically disposed on a stranded core of insulating fibers which have been coated and impregnated with conductive carbon.

6 Claims, 4 Drawing Figures

FLEXIBLE SELF-LIMITING HEATING CABLE

BACKGROUND OF THE INVENTION

In recent years, the use of positive temperature coefficient (PTC) materials in connection with electric heating elements has become more and more widespread because of the advantages flowing from its self-limiting temperature characteristics. Various types of heating cables have been devised in which a pair of spaced conductors are separated by the PTC material which has been extruded over the two conductors. The PTC material between the two conductors provides a relatively low resistance path from the one conductor to the other. The heat is actually produced in the PTC material and one might consider the PTC material between the two conductor wires as a plurality of parallel resistance heaters disposed between the two conductor wires.

The PTC material typically may consist of a polyethylene material to which a dispersion of conductive carbon black has been added. Reference may be had to Bedard et al U.S. Pat. No. 3,858,144 which describes the constituents of suitable PTC materials for use in heating cables and the manner in which such materials might be processed including the annealing step. The Bedard et al patent also mentions the problems associated with the low contact resistance between the PTC material and the conductors which supply the current to the PTC material.

In the above-cited Bedard et al patent, improved stability and better and more consistent interface conductivity between the conductor wire and the PTC material is said to have been achieved by precoating the electrodes with a composition containing conductive black prior to deposition of the carbon black polymeric matrix by extrusion onto the electrodes. This results in the polymeric matrix having substantially greater amounts of carbon black at the interface than elsewhere. However, the type of conductor disclosed in the above-cited Bedard et al patent would not be suitable for use in electric blankets and other environments wherein repeated flexing is required and the wire must be easily flexed.

BRIEF SUMMARY OF THE INVENTION

The invention provides means of obtaining a thin, flexible PTC cable having uniform resistance characteristics and stability. The cable includes a pair of conductors which are composed of helically wound strips of a high conductivity material such as copper wound on an insulating flexible core formed of fine threads of fibers such as rayon or glass which are retained in their circular configuration by means of the helically wound ribbon or wire. The core of insulating material is coated with a solution or suspension of conductive carbon particles which are deposited on the core and because of the structure of the core, being made up of many fine threads, the carbon tends to infiltrate or work itself into the interstices between the threads of the core. The carbon deposited therein alters the electrical conducting characteristics of the core providing a further low resistance path from the PTC material to the conductor wires wound on the core. When the PTC material is extruded on the conductors with their carbon coated cores, some of the surface carbon is absorbed into or dispersed in the surface layer of the PTC material to provide improved interface conductivity between the PTC material and the carbon impregnated core and providing a low resistance path to the inner surfaces of the conductor wires.

It is an object of the present invention to provide a small, flexible heater cable suitable for use in an electric blanket and utilizing PTC material as a self-limiting heater.

It is a further object of the invention to provide a PTC blanket while having improved flexibility characteristics and exhibiting improved resistance stability.

It is another object of the present invention to provide an improved heater adapted for use in electric blankets having PTC material extruded over a pair of spaced conductors each made up of a flexible insulating core over which a helical conductor wire has been wound, the core being coated with a conducting carbon dispersion to improve the conductivity between the PTC material and the conductor wire.

Further objects and advantages of the present invention will become apparent as the following description proceeds and the features of novelty which characterize the invention will be pointed out with particularity in the claims annexed to and forming a part of this specification.

BRIEF DESCRIPTION OF THE DRAWINGS

Referring now to FIG. 1 of the drawings, there is shown a heater cable designated generally by reference numeral 12. The heater cable 12 includes a pair of spaced conductors 14 and 16 which are supported in their spaced relationship by extruded PTC material which may take the form of polyethylene loaded with conductive carbon black to obtain the desired resistance characteristics.

Figure 1:
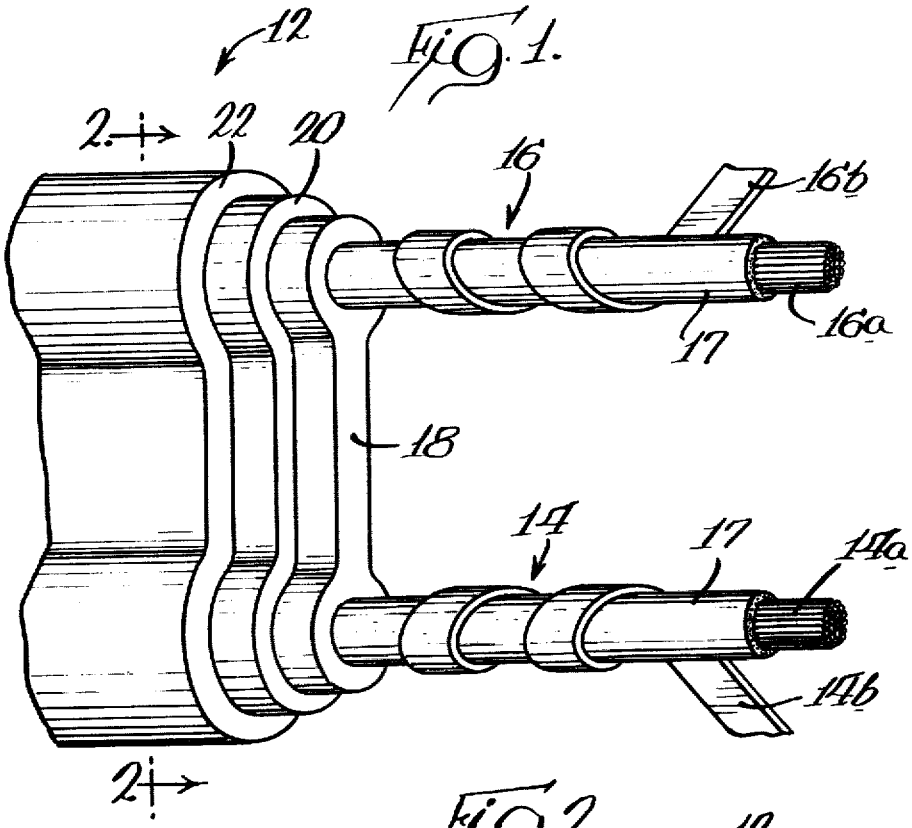
FIG. 1 is a perspective, fragmentary view of a heater cable embodying my invention.

Each of the conductors 14 and 16 include a core **14*a* and 16*a* respectively and helically wound conductor wires 14*b* and 16*b* respectively. The conductor wires 14*b* and 16*b* are formed of copper and have a cross-section of about 0.0025 inches by 0.010 inches. The cores 14*a* and 16*a* are about 0.018 inches in diameter and are formed of a plurality of glass or rayon threads having a denier of 1650 which have been bundled together into a generally cylindrical configuration as illustrated in FIG. 1 and are retained between helically disposed conductor wires 14*b* and 16*b***.

The cores **14*a* and 16*a*, in accordance with my invention, are dipped in a solution containing dispersed conductive carbon particles. The solution may be either a water or alcohol base and is sufficiently fluid to permit the carbon particles to be deposited in the recesses and voids left between the threads of glass or rayon which make up the cores. This application of the carbon to the cores 14*a* and 16*a* may be performed before or after the conductors 14*b* and 16*b*** are wound on the core. A more complete penetration of the carbon, however, may be realized if the cores are coated prior to winding the conductors on the cores.

When the PTC material 18 is extruded on to the conductors 14 and 16, the surface portion of the conductive carbon deposited on the cores 14a and 16a becomes part of the surface of the PTC material since the material is in a fluid or molten state as it is extruded. The result is a highly conductive portion of PTC material at the interface between the PTC material and the cores 14 and 16. Thus, it should be noted that current passing between the conductors 14b and 16b into the PTC material may either pass through the surface of the conductor wires in direct contact with the PTC material or may be conducted lengthwise through the deposited carbon layer in the core and into areas of the PTC material disposed between the turns of the helically wound conductor wires 14b and 16b. Providing the current with various paths improves the characteristics of the heater cable and provides more uniform conductivity between the two conductor wires.

Figure 3:
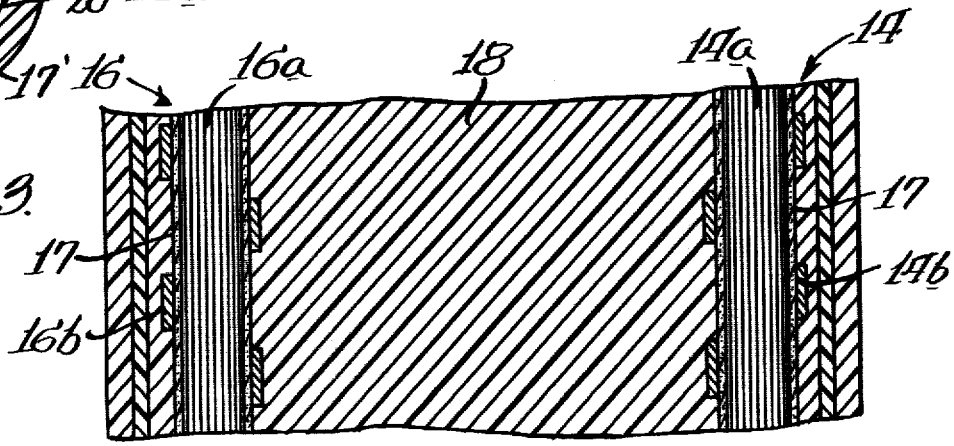
FIG. 3 is a further sectional view taken lengthwise through the heating cable.

Considering the cross-sectional view of FIG. 3, one may readily observe the increase in conductor area provided by the coating of the insulating conductors 14a and 16a with the conductive carbon black. The layer 17 between the cores 14a, 14b and the PTC layer 18 is shown in somewhat exaggerated form but is intended to represent the layer of carbon black which actually extends into the cores as explained above. Without the conductive coating, the helically disposed conductors 14b and 16b are disposed adjacent each other on the near sides of the conductors 14 and 16 in a somewhat random fashion whenever the turns are properly oriented. In other instances, much of the conductor is located on the side of the insulating core away from the adjacent conductor, thereby limiting the current flow to that portion of the wire. However, with the entire length of the conductors 14 and 16 having either a portion of the conductor wires 14b and 16b exposed to the adjacent conductor or having a conductive portion 17 of the cores 14a and 14b exposed, the current flow between the two conductors 14 and 16 tends to be uniform and directly between the two conductors, thereby providing the maximum and most uniform heating in the PTC material 18.

The fine glass or rayon fibers used in the cores 14a and 16a provide strength and flexibility for the heater cable. The conductive carbon coating of the core has no tendency to lessen the flexibility thereof and improves the electrical characteristics of the conductors 14 and 16 as described above. By having the copper wires 14b and 16b helically disposed on the flexible cores 14a and 16a, the flexibility of the heater cable is not lessened by the presence of the conductor wires. In addition, by having the wires helically disposed, the effects of flexure of the heater cable on the wires is minimized. The heater cable may be flexed frequently with no danger of breaking the conductor wires 14b and 16b.

In order to stabilize the electrical parameters, the PTC coated wire is annealed at a temperature at or above the melting point of the polyethylene material. To maintain the physical configuration of the PTC material 18 during its annealing, there is provided a layer 20 of thermoplastic material which is extruded over the PTC material 18 prior to its being annealed. After the annealing has been completed, the thermoplastic rubber coating 20 may either be removed or left in place. Thereafter, a further coating 22 of polyvinyl chloride is extruded thereon to provide an insulating coating which may be suitably sealed at the junctions and connectors provided for the heater cable 12. Depending on the particular type of PTC material used and the annealing process to which it is subjected, the thermoplastic layer 20 may or may not be required.

The resulting assembly is strong, flexible and durable having suitable characteristics for use in electric blankets, electric underblankets, sheets and the like. The wire may be made small enough as to be hardly noticed in the conventional blanket shell, and it may be made sufficiently flexible that the blanket may be folded and flexed with the heater cable providing no noticeable resistances to such folding and flexing. In addition, the heater cable has the advantages inherent in a PTC heater cable that it is self-limiting in the areas in which any overheat conditions might develop or occur. When used in an electric blanket, such a heater cable results in a blanket which will have the ultimate in safety protection insofar as local overheat conditions are concerned, and at the same time will distribute heat evenly and efficiently to all areas of the blanket.

Figure 2:
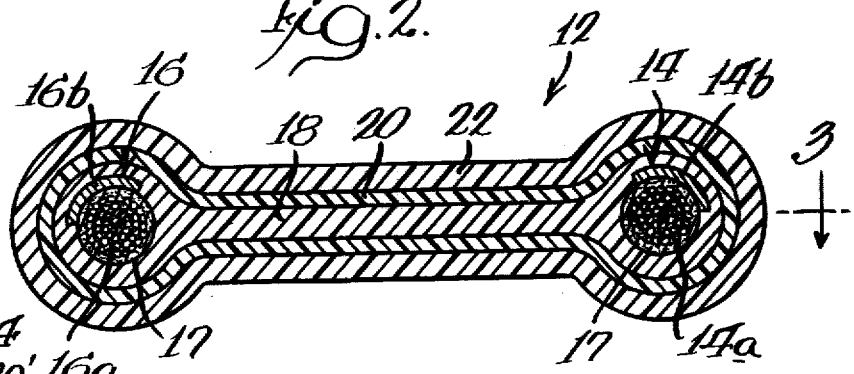
FIG. 2 is an enlarged sectional view taken on line 2—2 of FIG. 1.
Figure 4:
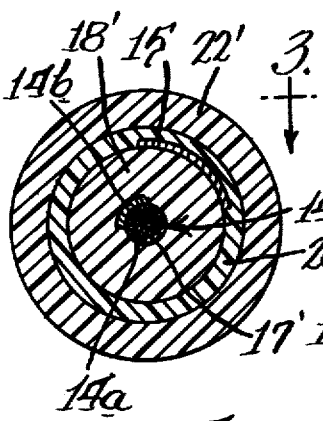
FIG. 4 is a sectional view of an alternative embodiment of my invention.

Referring to FIG. 4, there is shown an alternative embodiment of my invention in which a single core 14a is utilized with one of the conductor wires 14b wound directly on the coated core while a second conductor wire 15 is wound helically on a layer of PTC material 18' extruded onto the first conductor 14. In this arrangement, the conductor wires 14b and 15 are disposed concentrically with respect to the core 14a with the cylindrical layer of PTC material 18' positioned between the helical conductor wires 14b and 15 also being concentric therewith. The outer conductor wire 15 is enclosed by a thermoplastic coating 20' and a polyvinyl chloride coating 22' as described in connection with the embodiment of FIGS. 1–3. The layer 17' of carbon applied to the core 14a in the embodiment of FIG. 4 corresponds to the layer 17 of the first described embodiment insofar as its function and manner of application is concerned.

While specific embodiments of the present invention have been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. In an electric blanket, a heating cable comprising a pair of elongated spaced conductors supported in spaced relation by a positive temperature coefficient material which serves as resistance heating means for said cable, each of said conductors includes a core of nonconducting flexible threads and a helically disposed ribbon of low resistance material wound on said core, said core of threads being impregnated with conducting carbon which provides a low resistance path lengthwise of said conductors on the inside diameter of said helically wound ribbon of material, said PTC material being extruded over said spaced conductors, and at least one insulating coating being extruded over said PTC material.

2. The combination of claim 1 wherein said PTC material is coated with a thermoplastic rubber to maintain the shape of the PTC material during annealing and polyvinyl chloride coating over said thermoplastic rubber coating.

3. The combination of claim 1 wherein said cores are impregnated with said conducting carbon by immersion of said cores in a liquid dispersion of conducting carbon whereby said carbon is deposited on the surface of said cores and within the interstices of the fibers of said cores.

4. The combination of claim 3 wherein said ribbon of material comprises high conductivity copper having a cross-sectioned area of approximately 0.000025 square inches.

5. In an electric blanket, a heating cable comprising a pair of elongated spaced conductors supported in spaced relation by a positive temperature coefficient material which serves as resistance heating means for said cable, one of said conductors includes a core of nonconducting flexible threads and a helically disposed ribbon of low resistance material wound on said core, said core of threads being impregnated with conducting carbon which provides a low resistance path lengthwise of said conductors on the inside diameter of said helically wound ribbon of material, said PTC material being extruded over said one conductor, and at least one insulating coating being extruded over said PTC material and said conductors.

6. The combination of claim 5 wherein said PTC material forms a cylindrical enclosure around said one conductor and core, the other of said spaced conductors being wound helically on said PTC material, and said insulating coating being extruded over said other conductor and said PTC material.

* * * * *